United States Patent [19]

Ritzenhoff

[11] 3,977,556

[45] Aug. 31, 1976

[54] METAL TEAR-OFF CAP

[75] Inventor: Hermann Ritzenhoff, Marburg an der Lahn, Germany

[73] Assignee: Gebruder Seidel KG, Marburg an der Lahn, Germany

[22] Filed: June 17, 1975

[21] Appl. No.: 587,709

Related U.S. Application Data

[63] Continuation-in-part of Ser. No. 313,460, Dec. 8, 1972.

[30] Foreign Application Priority Data

Dec. 9, 1971 Germany ..... 2161026
July 9, 1974 Germany ..... 2432902

[52] U.S. Cl. ..... 215/256
[51] Int. Cl.[2] ..... B65D 41/32
[58] Field of Search ..... 215/250, 253, 254, 256; 220/270

[56] References Cited

UNITED STATES PATENTS

| | | | |
|---|---|---|---|
| 1,875,431 | 9/1932 | Fabrice | 215/256 |

FOREIGN PATENTS OR APPLICATIONS

| | | | |
|---|---|---|---|
| 1,079 | 9/1931 | Australia | 215/254 |
| 540,552 | 10/1941 | United Kingdom | 215/256 |
| 962,374 | 7/1964 | United Kingdom | 215/256 |

*Primary Examiner*—Ro E. Hart
*Attorney, Agent, or Firm*—Connolly and Hutz

[57] ABSTRACT

A metal cap for crimping on the neck of a container has one or two tear lines of reduced strength about its skirt which define a tear-off strip. A perforation for initiating tearing extends across the width of the strip and at least one smaller perforation is also provided in the strip. A tear-off tab (plastic tape) engages both sides of the strip and is joined together through the smaller perforation. The portion of the tear line adjacent the larger perforation may be scored to facilitate initial rupture in the desired direction. One or more circumferential reinforcing ribs may be provided in the skirt on one or both sides of the tear-off strip.

12 Claims, 7 Drawing Figures

METAL TEAR-OFF CAP

CROSS-REFERENCE TO RELATED APPLICATION

This application is a continuation-in-part of commonly assigned application Ser. No. 313,460, filed Dec. 8, 1972, by the same inventor.

BACKGROUND OF THE INVENTION

The present invention concerns a metal tear-off cap which acts as a pressure closure means and can be secured by crimping on to the neck of a container. The cap has a tear-off strip extending around the cap surface, bounded by at least one tear line of reduced strength, a portion of the tear-off strip being covered by a foil.

Among the requirements for an ideal pressure closure means are that it should provide a good seal and it should be capable of ready removal without the use of a tool or implement.

Furthermore, the holding tabs produced by punching operations have the disadvantage that a hardening of the material occurs all around the cut edges. Such a hardening interferes with the functioning of the holding tab at the two points where the holding tab ends and the tear-off strip starts. The undesirable initial resistance which occurs when pulling off the tear-off strip greatly hinders opening of the container. An even greater disadvantage are tears in undesired directions produced as a result of the hardening, which prevent the proper functioning of the cap.

A further disadvantage of the known tear-off cap is that is their production a sensitive punching tool is required for punching out the holding tab. Since the holding tab is connected with the tear-off strip only at one narrow side for securing the foil or film the other three sides are free, there must be a tongue of appropriate shape in the matrix of an appropriate punching tool. This free narrow tongue of the tool is extremely sensitive to shock and pressure and therefore not well suited for robust mechanical production with several hundreds of punchings per minute.

This tool construction causes the further disadvantage that for the tear-off strip one must not exceed a minimum height required to fasten the free tongue in the matrix. Thus, the shape of the holding tab necessarily determines the height of the tear-off strip and therefore influences the total height of the cap. For this reason, the tear-off strip cannot be formed in a narrower size, which would make it possible to reduce the height of the cap. In the production of an enormously large number of caps, even a small reduction in height would afford a very large saving of material and cost. The closure means desirably should show whether the original contents of the bottle have been tampered with, and it must be hygienic and have no adverse effect at all upon the contents of the bottle. However, many existing pressure closure means fail to meet all the above requirements. Thus, for example, the known screw-on-caps do not guarantee that the original contents of the container have not been interfered with, and crowned caps cannot be removed without the use of an implement.

There are existing metal tear-off caps for sealing bottles and other containers, which have a tear-off strip, a portion of the tear-off strip being covered by a foil or film. German Pat. No. 1,204,544, for example, describes a tear-off cap, part of the tear-off strip of which is formed to provide a holding tab by means of a perforation of the cap skirt, the performation for said holding tab being covered by a foil also extending around the latter, which foil may project over the free end of said holding tab and can be secured to the holding tab through openings.

This and other tear-off caps with a tear-off strip and a punched-out holding tab — with and without covering foil — which are to be secured on to the neck of a container by crimping, have the disadvantage that they cannot be used as pressure closure means since the skirt surface of the cap is radially perforated along the length of the holding tab. If after closing a container by means of such a tear-off cap, an axial pressure is exerted upon the cap from inside by the contents the skirt surface normally compressed onto the neck of a container arches upwardly above the longer radial perforation despite the crimping; and the seal is destroyed.

In addition, the long radial perforation of the cap skirt interferes with the smooth passage of the cap through the feed mechanism and the machine. The cap skirt, which has reduced strength due to the perforation for the holding tab, tends to be dented at the high transport rates in the sorting and conveying systems, which damage the caps and interfere with their transportation.

This invention also concerns a metal tear-off cap which acts as a closure means capable of withstanding pressure and vacuum force and can be secured by crimping on to the neck of a container, which cap has a tear-off strip, extending around it and bounded by one tear line of reduced strength, and a film on a part of the tear-off strip, a narrow opening being formed at one point in the tear-off strip and at least one small aperture being formed therein farther round from said opening in the direction in which pull is applied, in which opening and aperture or apertures is secured a holding tab consisting of a tear-resisting piece of film, as previously described herein.

The previously described tear-off cap was developed as a closure means capable of withstanding pressure. Initially however, it was not thought that one and the same metal tear-off cap could be used as a closure means that could withstand both pressure and a vacuum force.

Generally, on the one hand caps are known which are intended to act as closure means capable of withstanding pressure, while on the other hand there are caps suitable for withstanding a vacuum force. Closure means for withstanding pressure are intended for sealing containers, especially bottles, the contents of which, e.g., carbonized beverages such as mineral water, lemonade, caffein-containing drinks and beer, generate an internal pressure. Closure means for withstanding vacuum force are used for sealing containers, the contents of which must be vacuum-sealed so as to keep them in good condition. Examples of products of this kind are milk, fruit, baby foods and meat.

The requirements imposed on closure means for withstanding pressure conflict with those imposed uon closure means for withstanding a vacuum force when these means are required to seal containers, especially bottles, and their contents in an air-tight manner. Whereas the sealing means for withstanding a vacuum force is automatically pressed on to the mouth of the bottle by the atmosphere on account of the reduced pressure in the bottle, a closure means for withstanding pressure must be connected so firmly to the mouth of the bottle that the closure cap cannot be lifted by the internal pressure.

When the closure means are opened, it is necessary in both cases to balance out the pressure difference betweeen the interior of the container and the surrounding atmosphere. For this purpose the closure means for withstanding pressure must lift i.e. permit the discharge of air at the commencement of the opening operation so that when this operation is completed the pressure in the container is relaxed. It is necessary to avoid removal of the closure means by the use of great force which might cause it to shoot off with the risk of injury to the user. When removing a closure means for withstanding a vacuum force, air has to be admitted to the container so as to balance out the pressure difference, since the closure means can only be readily removed after such equalization of pressure has been achieved. Thus, when removing the two kinds of closure means, the pressure is equalized in one direction in the one case and in the opposite direction in the other, i.e., air is released in the case of the closure means for withstanding pressure, and is admitted to the container in the case of pressure means for withstanding a vacuum force. Discharge of air is facilitated by the internal pressure, whereas the admission of air is rendered difficult by the relative exterior pressure.

Because of these conflicting requirements imposed on closure means for withstanding pressure and closure means for resisting a vacuum force, it has hitherto been thought that the ideal form of closure means for withstanding pressure must differ from that of closure means for withstanding a vacuum force.

The invention is directed to the object of providing simple and economical metal tear-off cap having a tear-off strip and foil on one portion of the tear-off band to be secured on to the neck of a container by crimping, which cap is useful as pressure closure means and meets all the above requirements to be met by a pressure closure means.

Another object of the present invention is to improve the aforementioned tear-off cap so that it can be used as a closure means for withstanding both pressure and a vacuum force.

SUMMARY

According to the invention there is provided a metal closure cap arranged to be secured to the neck of a container by crimping, the cap having a tear-off strip extending around the cap bounded by at least one tear line of reduced strength relative to the rest of the metal of the cap, wherein the tear-off strip starts at one perforation, at least one other perforation narower than the strip is formed in the strip, and a holding tab is secured to the strip through the perforations.

According to the invention, this object is achieved in that the tear-off line is provided at such level just below the upper edge of the cap and the thickness of the material is so selected that after the tear-off strip has been torn to the extent of 120°, the resistance to bending of the swingable arcuate portion of the top-surface so created lies between 0.3 and 1.5 atmos. The invention makes it possible for one and the same tear-off cap to be used for sealing containers and especially bottles put to all the possible different uses, viz, for accommodating products which generate an internal pressure, or products that have to be vacuum sealed, and of course for containing products which neither generate an internal pressure nor require to be vacuum-sealed. This means that similar bottles and containers can now be used for all types of application, and thus containers can be produced economically and at a high rate and sold at an attractive price to the customer who can store them at low cost. Also returned bottles and containers can be used again for any of the envisaged purposes. The low-cost return of used bottles to any selected place for refilling, as in the case of the standardized beer bottle, is a necessary prerequisite to the solution of the ecological problem created by the need for disposing of "empties."

A further particular advantage of the tear-off cap of the invention resides in the fact that it is also suitable for sealing off contents which initially generate an internal pressure when the container is closed and thereafter form a vacuum, e.g., foods which are heated immediately after their containers have been sealed.

The tear-off cap of the invention meets all the requirements imposed upon the ideal closure means for withstanding pressure and the ideal closure means for resisting a vacuum force, i.e., it provides a tight seal, can be used again for excluding dust from the container and its contents, insures that the contents have not been tampered with, prevents any deterioration of the contents, is acceptable from the point of view of hygiene, and can be safely and easily removed without a tool or implement to discharge air from or admit it to the container.

Existing closure means for withstanding pressure and a vacuum force are generally difficult to remove or incapable of being removed without the use of a tool or implement. If no tool or implement is required, then the known sealing means do not insure that the contents of the container have not been tampered with.

Bottle caps having a tear-off line just below their upper edge have been primarily used as decorative caps that do not effect a seal, and they have been made of relatively soft metal or plastics material.

The tear-off cap of the invention, which can be used as a sealing means for withstanding both pressure and a vacuum force, consists of a strong metal, for example a strong aluminum alloy or tin plate, and can be secured to the neck of the container by crimping. As is well known, crimping involves bending the lower edge of the cap round a rim or projection on the neck of the container. This operation results in the lower edge of the cap becoming firmly connected to a complementary zone of reduced cross-section on the neck of the container. In the case of closure means for withstanding high internal pressures, the strength of this connection is preferably further increased by rolling in the lower edge of the cap.

Like the first-described cap herein, the tear-off cap of the present invention comprises a tear-off strip which is bounded at least one tear-off line, extends right round the cap and has a narrow opening and, farther round from this opening in the direction in which pull is applied to the strip, at least one small closed aperture. A holding tab, made of a tear-resisting piece of film or foil is secured in this opening and in the aperture.

According to the present invention and to enable this tear-off cap to function as a closure means for withstanding both pressure and a vacuum force, the tear-off line just below the upperedge of the cap is disposed at such a level that after the tear-off strip has been torn to the extent of 120°, a certain resistance to bending is achieved. This resistance to bending of the swingable arcuate portion created by tearing the tear-off strip to the extent of approximately one third of the circumference depends mainly upon the thickness of the material of the cap and upon the depth of that part of the cylindrical wall of the cap that remains above the tear-off line, and according to the invention this resistance must lie between 0.3 and 1.5 atmos. Preferably it lies between 0.5 and 1.0 atmos.

In contrast to the known closure caps for withstanding pressure or a vacuum force, the tear-off strip of the cap of the invention represents by far the major part of the cylindrical surface of the cap, so that after the strip has been torn off and removed a non-stable, readily bendable cover remains which consists of the top surface and a very narrow remnant of the cylindrical part of the cap that remains above the tear-off line.

When removing the closure means from containers accommodating products that generate an internal pressure, by tearing the tear-off strip to the extent of only approximately one third of the circumference, the flexibility of the upper remaining cap enables the internal pressure to lift the seal at one point, so that this pressure is relaxed. Thus, before the risk of the closure means flying off could arise by tearing away say one half of the tear-off strip, the internal pressure is relaxed so that the closure means can be easily removed without danger.

When the cap is used as a closure means for withstanding a vacuum force, its form also ensures that air will readily enter the container with the aid of the upper non-stable cover. When the vacuum is low, the tearing of the tear-off strip applies a radial pull to the remaining upper cover and this leads to displacement of the sealing insert in relation to the mouth of the container, and thus to the entry of air into the interior. When the vacuum is very high, it may be necessary, after the entire tear-off strip has been pulled away, to lift the rest of the cover with the thumb at one point. Since the stability of this remaining cover is so low that it can be bent up at one point, the force necessary for lifting this small surface is very low. The situation is different in the case of inherently stable stong covers. These do not permit just a part of the cover to be raised and air to be admitted to the interior of the container. Inestead it is necessary to use the force required for counteracting, at a stroke, the external pressure applied to the entire surface of the top. Thus, the force required is the product of the external pressure and the entire area of the top. With the arrangement in accordanace with the invention on the other hand, only a sector of the circular area of the top requires to be lifted in order to admit air to the container. Experience has shown that after air has been admitted, the remaining part of the top can be conveniently removed.

It is is required to preserve the remaining cover and to use it as a dust-excluding cap, the cover should not be too weak when the cap is to be used for withstanding a vacuum force, since otherwise it would not be possible to break down the vacuum except by destroying the upper cap by making an incision therein or by puncturing it. THus, Thus, is necessary to keep to the specified resistance to bending of 0.3 to 1.5 atmos., in order to fulfill all the requirements imposed on a closure means for withstanding pressure or a vacuum force.

In a preferred form of the tear-off cap of the invention, an outer or inner rim extends immediately below the parallel to the tear-off line. This rim which extends right round the cylindrical wall of the cap performs the function of strengthening the cylindrical wall and of uniformly distributing in the downward direction the forces acting on the top surface. This can be particularly advantageous if the contents to be sealed in the container generate a high internal pressure.

In a further preferred form of the tear-off cap of the invention, a row of spaced pips is provided above the tear-off line. These pips facilitate the lifting of a sector of the top surface when a high vacuum obtains in the container.

BRIEF DESRIPTION OF THE DRAWING

In order that the invention can be fully understood and readily carried into effect, it will now be described in greater detail with reference to the accompanying drawings, in which.

DESCRIPTION OF THE PREFERRED EMBODIMENTS

FIGS. 1-3

Figure 1:
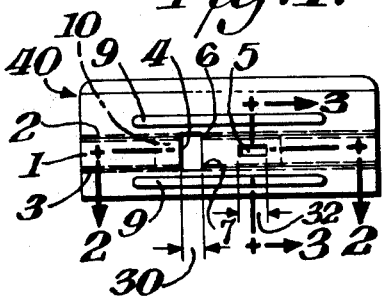
FIG. 1 is a lateral view in elevation of one example of a cap in accordance with the invention before the holding tab has been secured, the subsequent position of the tab being marked in phantom outline.

FIG. 1 shows a tear-off cap 40 made of one of the metals usually employed, preferably aluminum, which cap comprises a tear-off strip 1 formed by two tear lines 2 and 3 of reduced strength. Tear lines 2 and 3 are lines of reduced cross section on the inner surface of cap 40, which will be disposed next to the container when cap 40 is attached to it. The tear-off strip 1, which extends completely around the cylindrical body of the cap, is interrupted at one point by a punched-out portion or perforation 4. To the rear of the punched-out portion in the direction of tearing or pull is an opening or smaller perforation 5. The punched-out portion 4 has two tear-initiating point 6 and 7. The tear-initiating points are located on the tear lines 2 and 3, and are scored on the outer surface in order to avoid incorrect tearing. The scoring is carried out during the punching operation by means of an appropriate form of die and in such manner that the work-hardening of the cut edges normally occurring during punching is avoided at each tear-initiating point.

Figure 2:
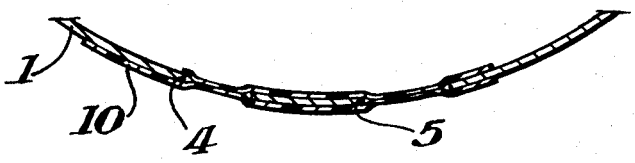
FIG. 2 is a partial section on the line 2—2 through FIG. 1, after the two-piece holding tab has been applied.

FIG. 2 shows a section through the tear-off cap of FIG. 1 after a two-piece holding tab 10 has been secured to the tear-off strip 1. The tab 10 is formed of a film or foil of, for example, plastics material bonded or welded on to itself through the opening 5. Foil 10 is, for example, a colored tear resistant plastic tape of polyethylene, terephthalate, polyproplylene or high density polyethylene. This bonding or welding is preferably effected by ultrasonic welding. A similar joint is also made through the punched-out portion 4. The outer portion of the holding tab 10 projects forwardly of the punched-out portion 4 and this projecting portion can be gripped to tear off the strip 1.

In the case of the cap 40 arrangement shown in FIG. 1, an opening 5 is formed in the middle of the tear-off strip 1 and to the rear of the punched-out portion 4. FIG. 1 also shows that reinforcing ribs 9 can be formed above and below the punched-out portion 4 and the opening 5.

Figure 4:
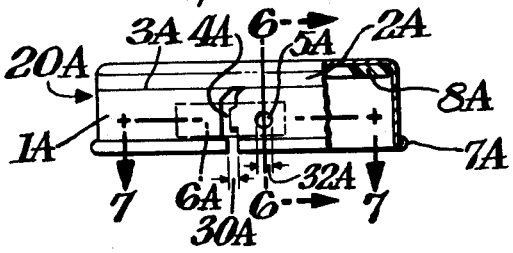
FIG. 4 is a side view in elevation, partly in section, of another tear-off cap in accordance with the invention before the holding tab has been secured, the subsequent position of the upper part of the holding tab being indicated.
Figure 5:
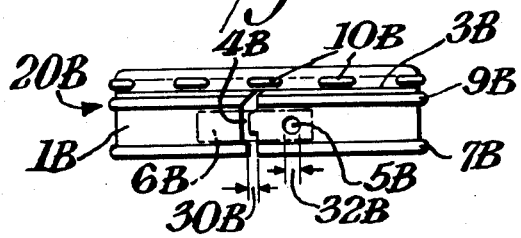
FIG. 5 is a side view in elevation of a particularly preferred form of the tear-off cap of the invention before the holding tab is secured.

Whereas FIG. 1 shows tear-off caps each comprising a tear-off strip 1 bounded by two tear lines 2 and 3 of reduced strength, FIGS. 4 and 5 illustrate caps in which the tear-off strip 1A or 1B is located at the lower end of the cylindrical body of the cap and is bounded by only a single tear line 3A or 3B of reduced strength.

Figure 3:
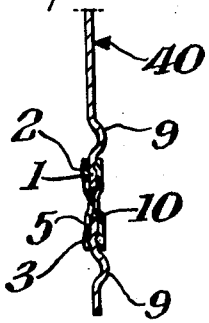
FIG. 3 shows a partial section on the line 3—3 through FIG. 1 after a two-piece holding tab has been applied.

FIG. 3 is a section through the attachment arrangement for a two-piece holding tab 10 again in the case of the cap 40, illustrated in FIGS. 3, the film being welded on to itself through the opening 5.

The circumferential dimension of opening 4 (designated 30) ranges approximately from 1.0 through 3.0 mm. for effective operation. A particularly effective example has a circumferential dimension for opening 4 of approximatley 2.0 mm. The circumferential opening for aperture 5 (designated 32) ranges approximately from 2.0 to 3.0 mm. and is particularly effective at 2.5 mm.

FIGS 4–7

The tear-off cap 20A shown in FIG. 4 consists of a tear-off strip 1A, which constitutes the major part of the cylindrical surface of the cap, and of the remaining cover 2A, which is comprised of the upper remaining cylindrical part and the top surface. When the closure means is to be removed, the tear-off strip 1A is torn away from the cover 2A along the tear-off line 3A. Formed in the tear-off strip 1A is a narrow opening 4A and, farther round beyond the opening 4A in the direction of pull, a small aperture 5A. A holding tab 6 is secured in the opening 4 and the aperture 5A. This holding tab 6A is made of a tear-resisting, weldable plastics braid or film. Examples of suitable tear-resisting and weldable plastics materials that can be used for the purpose are polyesters or polyvinylchloride. Polyvinylchloride reinforced with fibre-glass for example may also be used.

Figure 6:
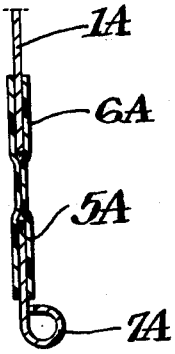
FIG. 6 is a section, on a greater scale, on the line 6—6 taken through FIG. 4, after the holding tab has been secured.
Figure 7:
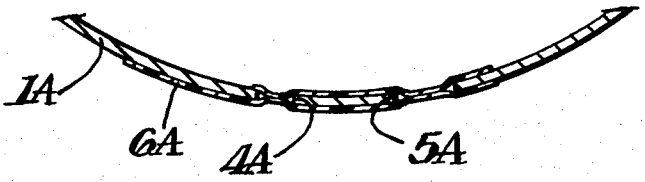
FIG. 7 is another section, on a larger scale, on the line 7—7 of FIG. 4 after a holding tab has been secured.

The holding tab 6A, the arrangement of which is shown in detail in FIGS. 6 and 7 consists of two parts, one of which is disposed above the tear-off strip 1A and the other below it. The two parts are welded together in the opening 4A and the aperture 5A, ultrasonic welding being preferably used for the purpose since only very small weld points are required in this method of welding. The opening 4A can therefore be made very narrow and the aperture 5A can be very small. The upper part of the holding tab 6A projects so far in front of the opening 4A that it can be gripped by this part.

In the arrangements shown in FIGS. 4 and 5, the tear-off cap has a rolled-in edge 7A or 7B which when crimped around a rim or projection on the neck of the container, imparts considerably increased strength and thus enables the mouth of the container to be sealed by the tear-off cap in a firm, pressure-tight manner. The seal between the cap and the surface of the mouth of the container is further strengthened by a sealing insert 8A which here is in the form of a ring but which could also take the form of a disc. The sealing insert is made of one of the usual sealing materials acceptable from the point of view of hygiene.

In a preferred arrangement shown in FIG. 5, the tear-off cap 20B also has an outer rim 9B which is located directly below the tear-off line 3B of reduced strength, reinforces the cylindrical wall to enable it to resist high internal pressure, and is intended to distribute, uniformly and in a downward direction, the forces acting on the surface of the top of the cap. The rim may also be formed on the interior of the cap. When the tear-off strip 1B is being torn, this rim also acts as a protection for the finger if the tear-off strip is gripped a second time rearwardly of the holding tab. The tear-off cap seen in FIG. 5 also has a number of pips or protrusions 10B which are disposed directly above the tear-off line 3B of reduced strength and are intended to facilitate lifting of a sector of the top surface when a high vacuum obtains in the container.

A feature of the invention that is important as regards the use of the tear-off cap as a closure means for withstanding both pressure and a vacuum force, is the level at which the tear-off line 3B is disposed, i.e., the depth of cylindrical surface that remains after the tear-off strip 1B has been pulled off. This level is dependent upon the material and diameter of the cap and, in particular, upon the thickness of the material. It must be so selected that the resistance to bending of the swingable arcuate portion, created by tearing the tear-off strip 1 to the extent of 120°, lies between 0.3 and 1.5 atmos., and preferably between 0.5 and 1.0 atmos.

If for example the cap is made of a strong aluminum alloy which is normally used for closure caps and which, in addition to aluminum, contains inter alia magnesium and silicon, and if the diameter of the cap is 36 mm, then the thickness of the material should be from 0.20 to 0.25 mm. The thickness of a cap made of tin plate and having a diameter of 36 mm should be from 0.16 to 0.20 mm. In these cases, the depth of the remaining cylindrical part that is necessary for providing the required resistance to bending of the arcuate portion created by tearing to the extent of 120° is approximately 2.0 to 3.0 mm.

The circumferential extent of openings 4A and 4B is similar to that of FIG. 1 as is the circumferential or diametrical opening of aperture 5A and 5B.

I claim:

1. An aluminum type sealing cap for crimping upon the neck of a container comprising a top, a substantially cylindrical skirt integrally joined to said top, at least one tear line of reduced strength disposed about said skirt for defining a tear-off strip relative to the remainder of said cap, a substantially concentrated aperture through said cap in said tear-off strip and extending across its width for initiating its separation from said remainder of said cap, the substantially concentrated aperture being of limited circumferential length whereby said cap is in itself capable of sealing the neck of the container to retain substantial internal pressure within the container, at least one smaller perforation in said tear-off strip which is narrower than said tear-off strip, a strong holding tab of separate material secured through said smaller perforation to said tear-off strip and inserted through said substantially concentrated aperture and disposed on both sides of said tear-off strip for grapsing and forceably initiating the separation and for separating said strip from said cap, said tab comprising a strong tear resistant plastic tape, said tape being joined together to itself and to said tear-off strip through said smaller perforation by an ultrasonic weld, said limited circumferential length of said aperture ranging from about 1.0 mm through about 3.0 mm., and the circumferential length of said perforation ranging from about 2.0 mm. through 3.0 mm.

2. An aluminum type sealing cap as set forth in claim 1 wherein tear initiating points are disposed at the junctions of said aperture with said tear lines in the direction in which tearing of said tear strip is initiated.

3. An aluminum type sealing cap as set forth in claim 1 wherein a circumferential reinforcing rib is provided in said remainder of said cap.

4. An aluminum type sealing cap as set forth in claim 3 wherein one of said reinforcing ribs is disposed on each side of said tear-off strip.

5. An aluminum type sealing cap as set forth in claim 1 wherein said tear lines are disposed in the surface of said cap disposed adjacent said container when said cap is secured on said bottle.

6. An aluminum type sealing cap as set forth in claim 5 wherein tear initiating points are disposed at the junctions of said aperture with said tear lines on the opposite surface of said cap and in the direction of tearing of said tear-off strip.

7. An aluminum type sealing cap as set forth in claim 1 which is capable of withstanding pressure and vacuum force whereby the tear line is provided at such a level just below the upper edge of the cap, and the thickness of the material is constructed and arranged that after the tear-off strip has been torn to an extent of 120°, the resistance to bending of the swingable arcuate portion of the top-surface so created ranges from about 0.3 through 1.5 atmos.

8. An aluminum type sealing cap as set forth in claim 7, characterized in that the resistance to bending of the 120° arcuate portion ranges from about 0.5 through 1 atmos.

9. An aluminum type sealing cap as set forth in claim 7, characterized in that a rim is disposed directly below and parallel to the tear line.

10. An aluminum type sealing cap as set forth in claim 9 wherein the rim is disposed exteriorly.

11. An aluminum type sealing cap as set forth in claim 7, characterized in that an array of protrusions is disposed directly below and parallel to the tear line.

12. An aluminum type sealing cap as set forth in claim 1 wherein said tape is also joined together to itself at said substantially concentrated aperture.

* * * * *